US006482102B2

(12) United States Patent
Grabowski

(10) Patent No.: US 6,482,102 B2
(45) Date of Patent: Nov. 19, 2002

(54) GOLF LEARNING AND GUIDE MAT

(76) Inventor: Gary Arnold Grabowski, 128 S. Zinnia Way, Lakewood, CO (US) 80228

( * ) Notice: Subject to any disclaimer, the term of this patent is extended or adjusted under 35 U.S.C. 154(b) by 0 days.

(21) Appl. No.: 09/810,757

(22) Filed: Mar. 19, 2001

(65) Prior Publication Data

US 2001/0036869 A1 Nov. 1, 2001

Related U.S. Application Data

(60) Provisional application No. 60/199,814, filed on Apr. 26, 2000.

(51) Int. Cl.[7] ..... A63B 69/36

(52) U.S. Cl. ..... 473/270

(58) Field of Search ..... 473/270, 218, 473/219

(56) References Cited

U.S. PATENT DOCUMENTS 4,000,905 A * 1/1977 Shirhall ..... 473/218
4,355,810 A * 10/1982 Rydeck ..... 473/218

* cited by examiner

*Primary Examiner*—Paul T. Sewell
*Assistant Examiner*—M. Chambers

(57) ABSTRACT

The present invention provides foot print patterns of different colors and club numbers associated to each foot and club to be used. In order to be able to stand and address the golf ball properly the foot print patterns are positioned in the proper locations for that particular club based on the vertical and horizontal center line of the golf ball so as to hit the golf ball properly. There are height lines wheras the user can move forward or backward or outwards or inwards to adjust to the user height. These colored foot print patterns will be silk-screened, sewed or glued on to commercial matting made of man known materials of different textures and thickness. The approximate size of this mat is 4 feet by 6 feet. The mat also comes in different colors.

1 Claim, 5 Drawing Sheets

GOLF LEARNING AND GUIDE MAT

This application claims the benefit of provisional U.S. application No. 60/199,814 filed Apr. 26, 2000.

BACKGROUND OF THE INVENTION

The present invention relates to a noval method of conceptual designed foot prints for the golfer a means to accurately align their stance pior to hitting or driving the golf ball at a target, more specifically, this invention relates to the golf mats for use at driving ranges that allow the golfer to correctly align stance before driving the golf ball at a target on the driving range.

Despite the plethora of devices available to the golfer in setting their stance, there presently no device, which teaches the neophyte golfer, how to position accurately, their feet to the number of club to be use for that particular target. How to position accurately their feet with respect to the number of targets at which they intend to hit the golf balls. Indeed, while golf practice ranges provide a variety of exact targets to aim at, there is a lack of an exact means to align their feed to these targets. It should be noted that two of the most basic fundamentals of the pre-swing preparation for golf shots are: 1) aligning the intended flight of the ball to the target, and the proper golf stance and club number to be used 2) having accomplished this, then aligning the stance to the ball. Failure to isolate and address these fundamental steps results in a great deal of mystery to the golfer when his/hers errant shots goes far right or left of the intended target. Not having mentally isolated the real problem (and therefore the correct solution), the anxious golfer the unwittingly begins to make various adjustments and "corrections" to his or her swing to counter-act the incorrect alignments. However the "corrections" are very deceptive. Although they straighten out the golf shots and have the appearance of improving the golfers game in actuality, they violate other fundamentals of a sound golf swing. Trained in over time, these improper corrections become bad habits with a resultant lower level of play for the sport at large. What is needed for golf practice ranges is a foot print mat which will provide the golfer with a sure and accurate means of aligning their foot stance prior to the golf shot to a plurality of targets.

Another shortcoming of prior art golf teaching mats is that they are unsuitable for the golf practice ranges. Unwieldy devices may not fit within the small confines of a golf mat. Flimsy devices will not stand up to the rigors of a practice range. Another problem, albeit one for the range owner, is that the use of unwieldy or time-consuming devices slow the golfer down while at the range. Range owners recognize the utility of golf training mats. The mat would increase use and speed turnover more profits.

What is needed is a durable mats for golfers (and) for golf practice ranges that will quickly, easily and safely provide a golfer with a precise means to align his/her feet for the stance to a plurality of targets.

SUMMARY OF THE INVENTION

The present invention relates to a practice visual aid for golfers, more particularly to footprints in adult male, adult female, and youth sizes in a rainbow of colors. These visual aids are for aligning his/her feet for the particular golf club to be used. This will serve as a guide and aid for the novice and everyday golfer. This visual aid will be printed or silk screened on man known materials. This media whether on matting material or other media can be transported to home, office, golf coarse or driving range; and laid on the ground or the present day driving range mats. This media or mat will aid the novice or everyday golfer with the proper stance for the particular club he has chosen for the particular target. This invention is comprised of a rectangular shaped mating material made from man known commercial materials or other chosen media, has a bordered area for the golfer to stand within to position oneself so he/she can properly align oneself with the particular golf club he/she has elected to use for that particular target. A Vertical line separates the left and right foot, which will be the centerline of the golf ball. The Horizontal lines at the base of the mat are height or length lines so the golfer would move up or backward on the foot pattern to match his/her height or length from the golf ball. The golfer will be able to move his/her feet inward or outward to adjust to their personal stance. The color of the footprints will vary through the rainbow of colors. At the center of the vertical and horizontal lines is a white circle, the size of a golf ball representing a golf ball. On either side of the white circle are arrows incorporated into the center top horizontal line, the left side points toward the target, the right side points toward the center line of the golf ball. A number will be on each foot pad indicating the particular golf club to be used with that particular foot pad, such as the number 1 wood, 9 iron, 5 wood, etc.

DETAIL DESCRIPTION OF THE PREFERRED EMBODIMENT

The present invention provides numerous adaptations for a golf-training mat that aids a golfer in aligning his/her feet to the proper stance and/for a shot using the correctly numbered foot print (10 FIG. 1) for that particular club. (10 FIG. 1)

In a preferred embodiment, the footprints are situated on the media/matting material, such that the golfer can step onto the properly numbered footprint pattern for that particular golf club he/she is using to hit the golf ball. By following the number footprints (10 FIG. 1) enabling the golfer to use the proper stance for that particular club.

A system for assisting a golfer in aligning his/her stance and his/her stance and shot with respect to a presighted target and a golf ball. (11 FIG. 1)

Figure 2:
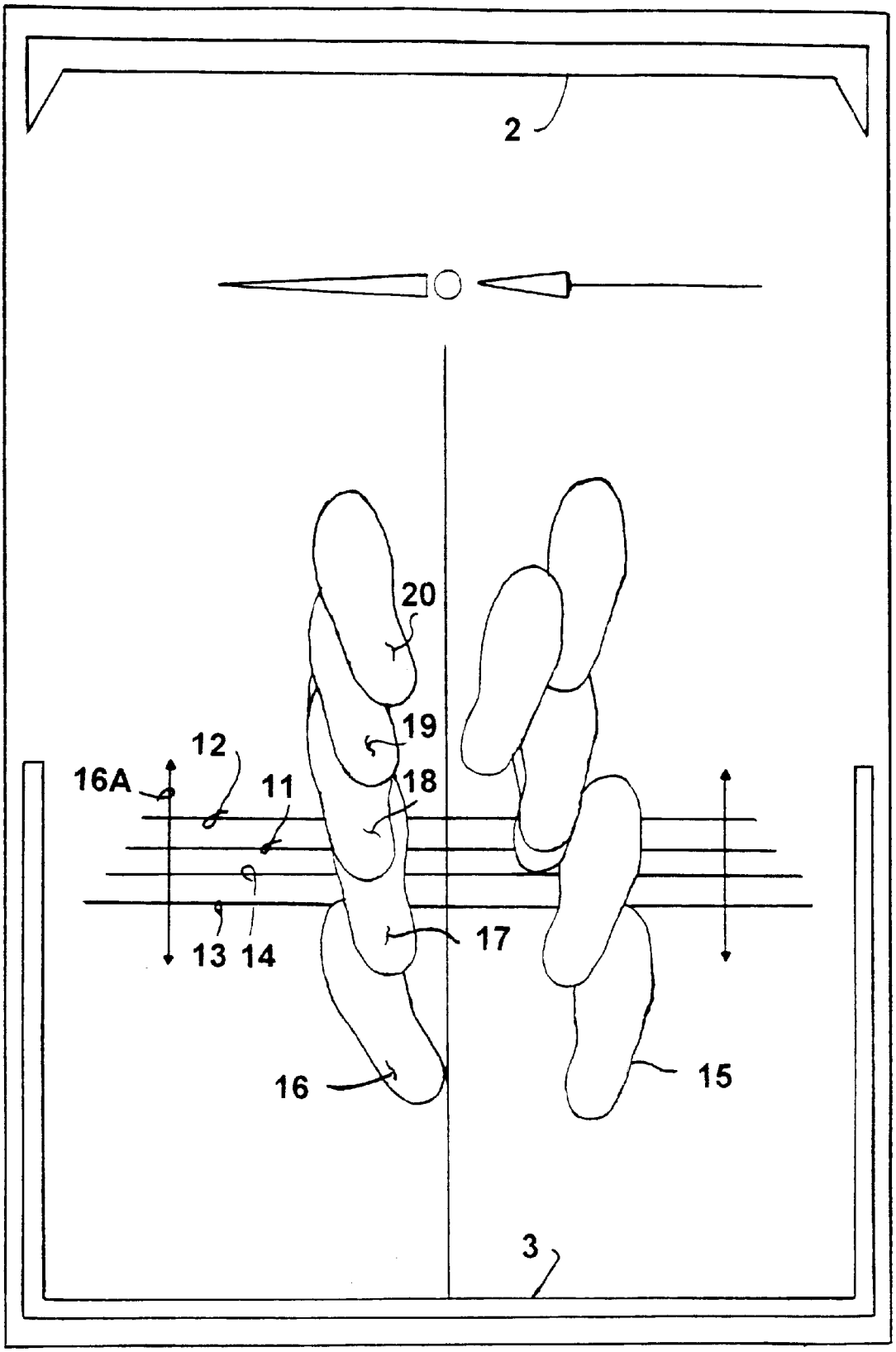
FIG. 2 Is the Top View showing it in a rectangular shape.

A golf mat of the present invention is comprised of a base mat (1 FIG. 3) which is rectangular in shape, approximately 4'×6', made of man known materials. Human footprints (15 FIG. 2), Height lines (11, 12, 13, 14, 16, FIG. 2), Target Arrow (9 FIG. 2), Golf ball indicator (8 FIG. 2), Golf ball center line indicator (30 FIG. 2) Vertical center line (16 FIG. 3), Horizontal arrow indicator (17 FIG. 3) Border lines (2 FIG. 2) Borderlines (3 FIG. 2)

An artificial turf texture is provided to the mats surface, similar to door matting materials. For example chemical fibers, rubber skid proofs base.

Figure 3:
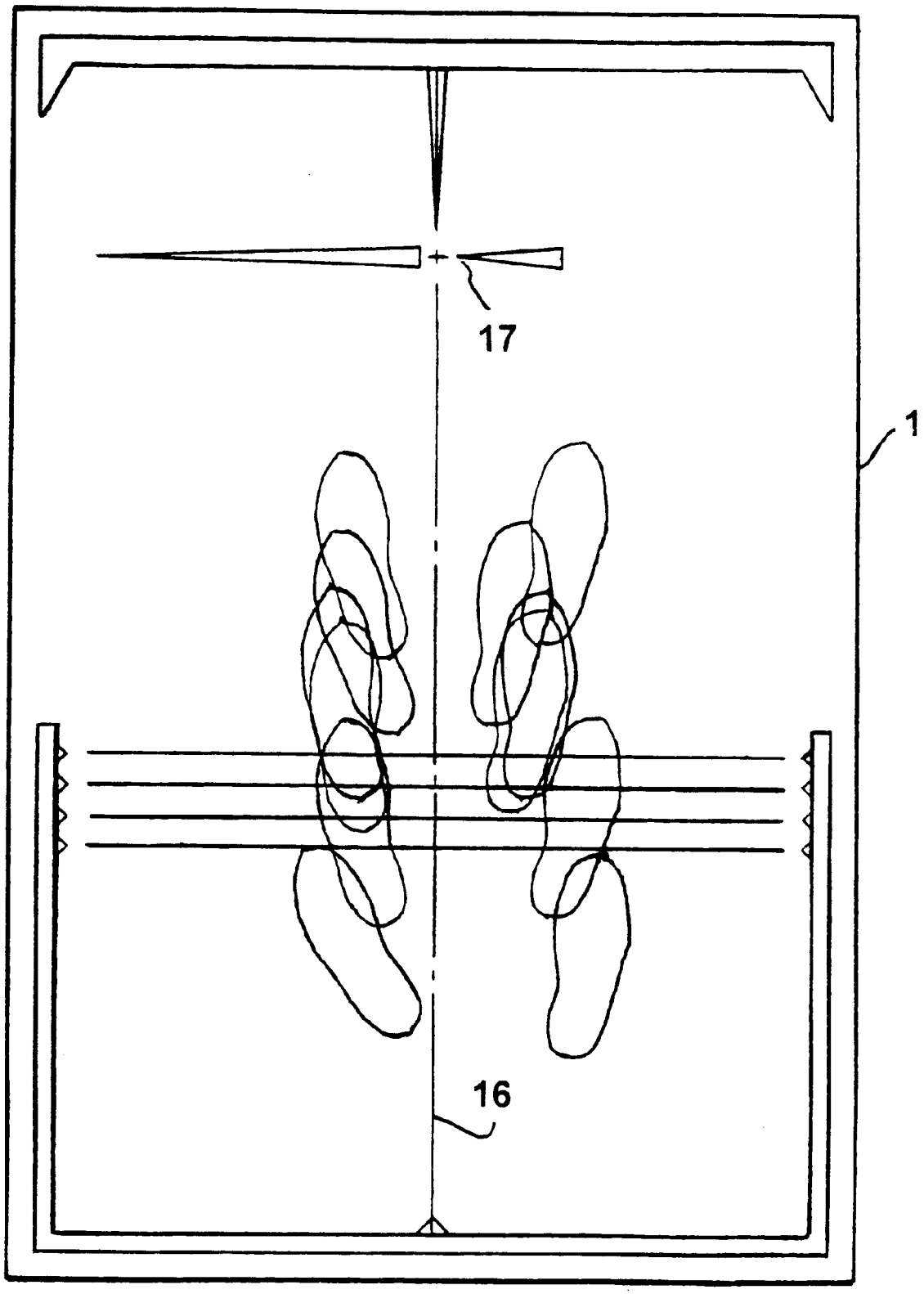
FIG. 3 Is the Top View of the mat media illustrating showing the footprint patterns for positioning his/her feet.
Figure 4:
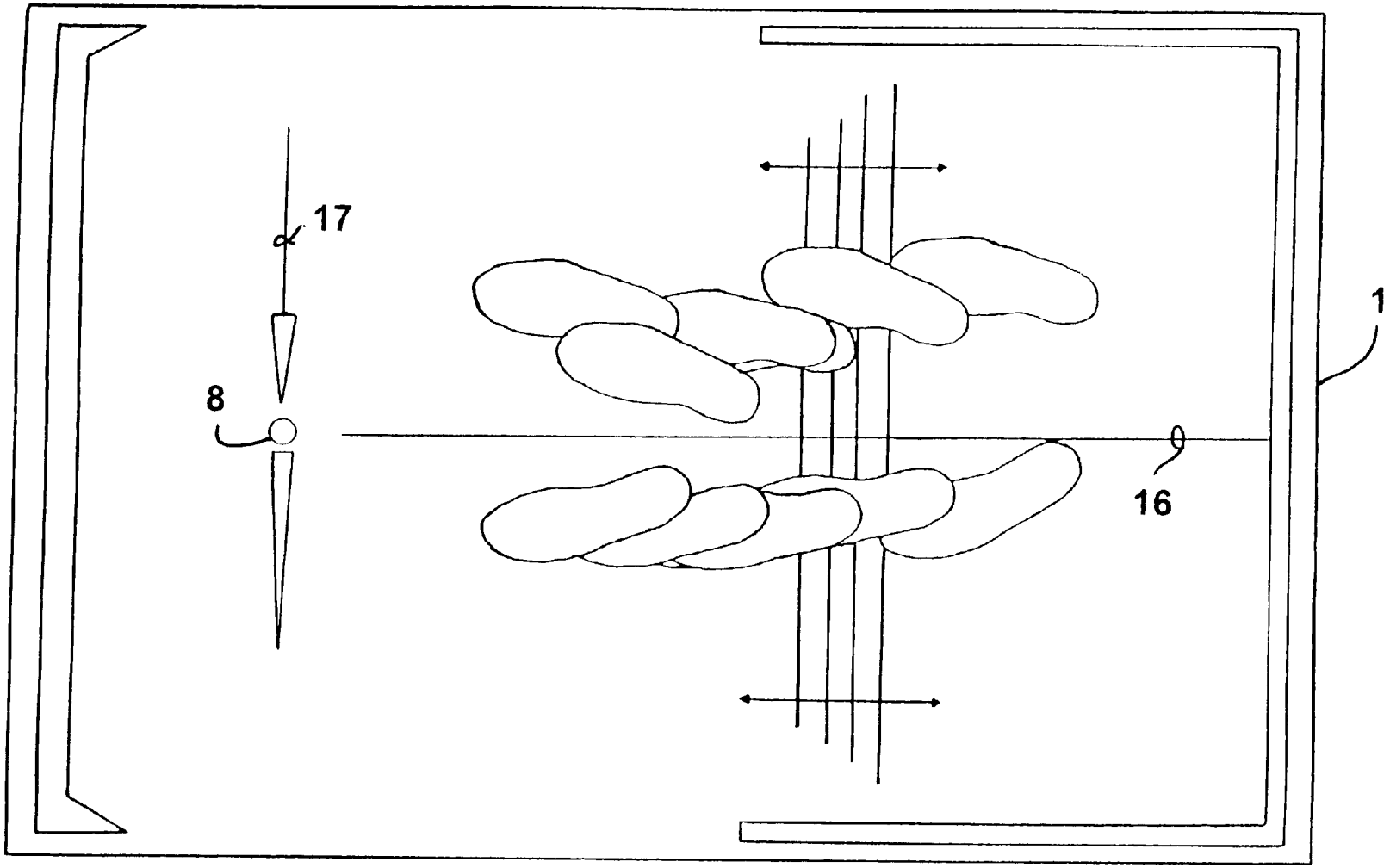
FIG. 4 Is the Top View of the mat showing illustrating the Ball Center Line Vertically, represented also the Horizontal center of the ball center line.
Figure 5:
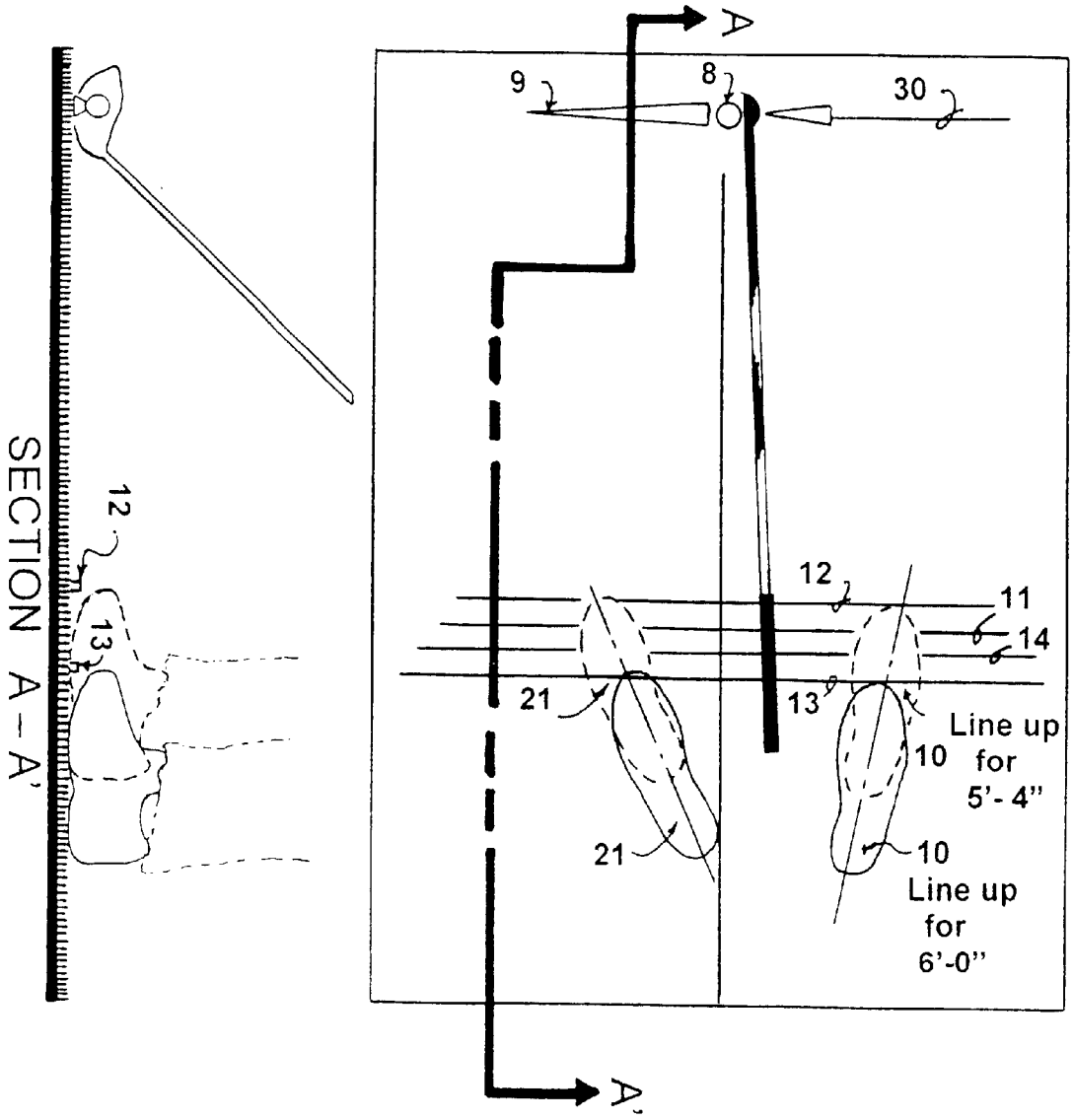
FIG. 5 Showing the Top View and Elevation A–A' Illustrating that each footprint is numbered for the golf club to be used and the aligned stance for that golf club. The top view showing the height line or length lines for address the and aligning his/her feet, starting at approximately 6'-0" in height, each line representing 2" in height, ranging from 6'-0" to 5'-4". Therefore the golfer can adjust his/her feet either up ward backward inward or outward to his approximate height.

There are no particular restrictions to the material used for the base of the mat (1 FIG. 3). However, from the standpoint of obtaining good contact with the ground, it is desirable to use a rubber backing, which has an appropriated weight of #20 lbs. or higher.

In actual practice, the golf mat of the present invention is first placed on the golf practice ranges grass, concrete surface, a private yard or in an office etc.

In example a golfer stands on the on the base mat (1 FIG.3) on the appropriate footprint (15 FIG. 2) with the coinciding club number (10 FIG. 1) that matches the footprint. Address the golf ball (8 FIG. 1) with club in hand, with the target arrow (9 FIG. 1) pointing at the target completes his/her swing and hits the target. For golfers shorter than 6'-0" adjustments can be made with the height lines (11,12, 13,14,16, FIG. 2); each line represents 2" in height. (13 to 14 FIG. 2) also (14 to 11 to 12 FIG. 2) Therefore the lines range from 6" 0" (13 FIG. 2) to 5' 4" (12 FIG.2)

Figure 1:
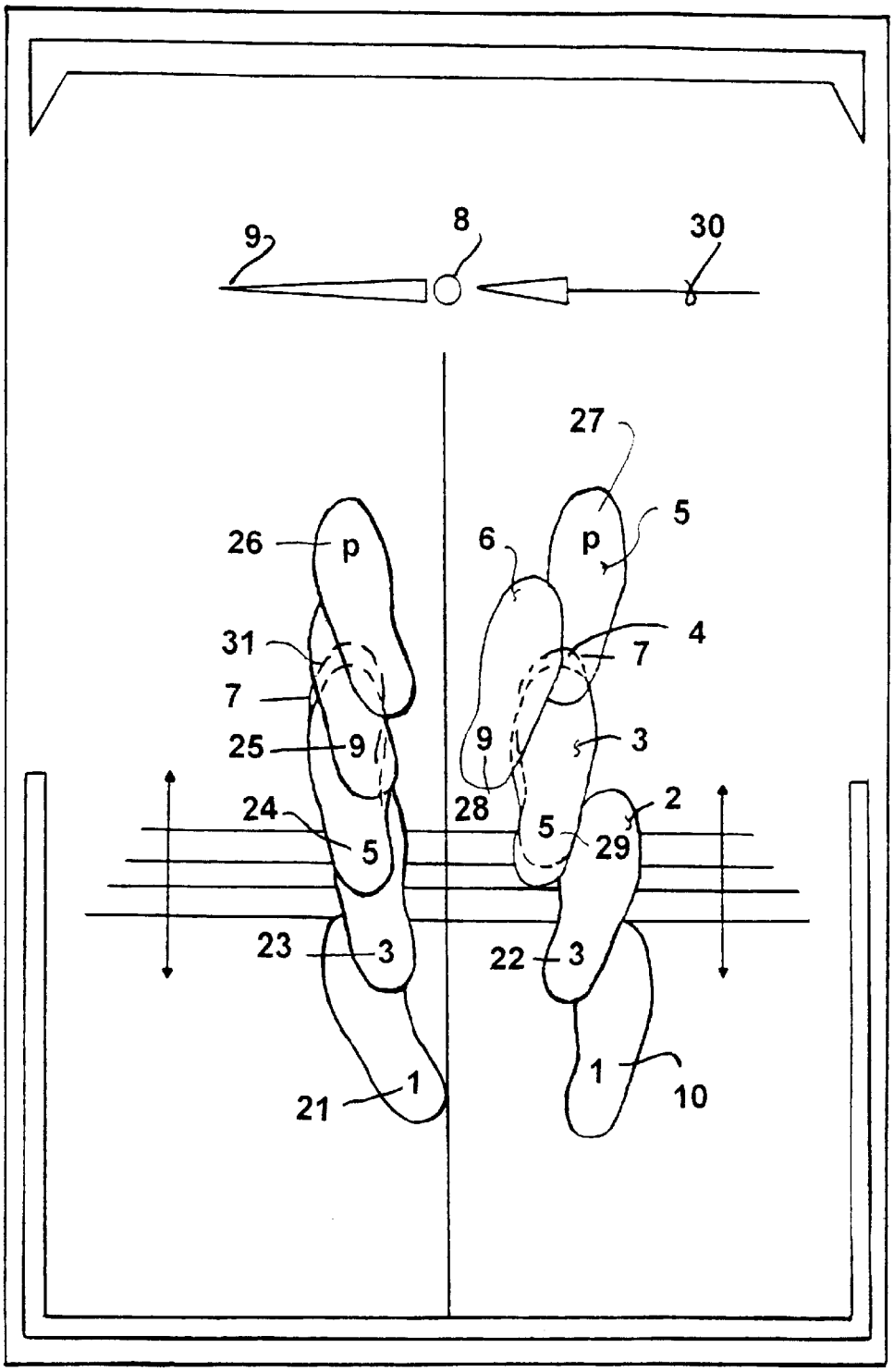
FIG. 1 Illustrated a Top View of the golf mat of the present invention showing the footprint patterns, which will be dyed, flocked, soen, onto man known materials.

In the preferred embodiment of the present invention, all of the human footprint are lined up in a sequential order (10,2,3,4,5,6, FIG. 1) (16,17,18,19,20, FIG. 2) Numerical golf club numbers are placed on each footprint (10,21,22, 23,24,25,26,27,28,29,31, FIG. 1).

The present invention provides a golf training device that aids golfer in aligning his/hers stance with respect to a plurality of targets.

What I claim is:

1. A golf mat media comprising:

a base matting media made of commercial matting materials of different textures and thickness; a golf guide and aid to provide a visual footprint pattern indicia;

each footprint indicia is numbered for the proper golf club to be used in a stance, each pair of footprint indicia for each club number will be in different colors;

an alignment footprint indicia dyed or fixed on the mat or media with the proper golf club number dyed or affixed on the mat;

the whole or segment of the whole human footprint indicia arranged in a sequential order and configuration over-lapping a whole or segment of the whole footprint in the correct alignment pattern so as to strike the golf ball correctly and properly;

a plurality of four parallel lines located on the elongated base spaced at 2" intervals for height and length adjustments for height ranging from 6'–0" to 5'-4";

a single perpendicular line intersecting the four parallel lines locating the centerline of the golf ball;

a second line with a directional arrow is perpendicular to the centerline forming the centerline of the golf ball.

* * * * *